US006321558B1

(12) United States Patent
Pruse

(10) Patent No.: US 6,321,558 B1
(45) Date of Patent: Nov. 27, 2001

(54) WATER SOURCE HEAT PUMP WITH HOT GAS REHEAT

(75) Inventor: Patrick D. Pruse, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/680,698

(22) Filed: Oct. 6, 2000

(51) Int. Cl.[7] ..... F25B 13/00

(52) U.S. Cl. ..... 62/324.6; 62/504; 62/524; 62/525

(58) Field of Search ..... 62/504, 524, 525, 62/324.6

(56) References Cited

U.S. PATENT DOCUMENTS

| | | | | |
|---|---|---|---|---|
| 1,837,798 | | 12/1931 | Shipley . | |
| 1,986,863 | | 1/1935 | Terry . | |
| 2,515,842 | | 7/1950 | Swinburne . | |
| 2,961,844 | | 11/1960 | McGrath . | |
| 3,203,196 | | 8/1965 | Malkoff . | |
| 4,232,529 | * | 11/1980 | Babbitt et al. | 62/160 |
| 4,517,808 | * | 5/1985 | Movshovitz et al. | 62/160 |
| 5,309,725 | | 5/1994 | Cayce . | |
| 5,400,607 | | 3/1995 | Cayce . | |
| 5,509,272 | | 4/1996 | Hyde . | |
| 5,622,057 | | 4/1997 | Bussjager et al. . | |
| 5,626,030 | * | 5/1997 | Nagai | 62/324.6 |
| 5,634,352 | * | 6/1997 | Nagai et al. | 62/324.6 |
| 5,664,425 | | 9/1997 | Hyde . | |
| 5,666,813 | | 9/1997 | Brune . | |
| 5,689,962 | | 11/1997 | Rafalovich . | |
| 5,927,093 | * | 7/1999 | Noguchi et al. | 62/259.1 |
| 5,937,669 | * | 8/1999 | Okuri | 62/324.1 |
| 6,167,715 | * | 1/2001 | Hebert | 62/260 |
| 6,223,549 | * | 5/2001 | Kasai | 62/324.1 |

* cited by examiner

*Primary Examiner*—William Doerrler
*Assistant Examiner*—Mark Shulman
(74) *Attorney, Agent, or Firm*—William J. Beres; William O'Driscoll

(57) ABSTRACT

A refrigerant system selectively operable in a cooling mode, a reheat cooling mode, and a heating mode, includes a primary heat exchanger and a reheat heat exchanger that condition air for a room. In the cooling mode, the primary heat exchanger functions as an evaporator that cools the air, while the reheat heat exchanger is inactive. In the reheat cooling mode, the primary heat exchanger cools the air, and hot refrigerant in the reheat heat exchanger reheats the air to provide dehumidified air at or near room temperature. In the heating mode, the primary heat exchanger functions as a condenser that heats the air, while the reheat heat exchanger is inactive. When the reheat heat exchanger is inactive, a unique venting arrangement prevents the inactive heat exchanger from becoming flooded with liquid refrigerant.

26 Claims, 3 Drawing Sheets

WATER SOURCE HEAT PUMP WITH HOT GAS REHEAT

BACKGROUND OF THE INVENTION

1. Field of the Invention

The subject invention generally pertains to refrigerant systems and more specifically to refrigerant systems that provide a reheat function in a cooling mode.

2. Description of Related Art

Refrigerant systems operating in a normal cooling mode typically have a refrigerant evaporator that cools a stream of air that is delivered to a room or some other comfort zone. Once the room's temperature (i.e., dry bulb temperature) reaches its target temperature, the refrigerant system may stop running. At times, however, this may leave the room uncomfortably humid. Thus, in some cases, the system may continue operating to reduce the humidity even after the sensible cooling demand of the room has been met.

To avoid over cooling the room in such cases, a heater downstream of the evaporator can be added to reheat the air after the evaporator cools and removes moisture from the air. Operating a refrigerant system in such a manner can be referred to as operating in a reheat cooling mode. In a reheat cooling mode, a refrigerant system can deliver relatively dry air to a room at a temperature close to its target temperature.

Often the heater is an electric coil, which effectively reheats the air, but wastes electrical energy. As an alternative to electric heat, a refrigerant condenser conveying hot refrigerant can possibly reheat the air. However, such an approach may create problems when the refrigerant system operates in modes other than the reheat cooling mode.

For example, when a refrigerant system with a reheat refrigerant condenser operates in a normal cooling mode without reheat, the inactive reheat condenser may flood with liquid refrigerant. The flooding may starve the rest of the system of its proper charge of refrigerant, thus reducing the system's overall efficiency in the normal cooling mode. Likewise, an inactive reheat condenser may flood and starve the rest of a refrigerant system when the system is operating in a heating mode to heat the comfort zone.

SUMMARY OF THE INVENTION

To provide a refrigerant system with a reheat cooling mode, it is an object of the invention to provide the system with an additional refrigerant condenser, which reheats the air that has been previously cooled by the system's evaporator.

Another object of the invention is to vent a reheat heat exchanger to an evaporator of a refrigerant system that is operating in a normal cooling mode, thereby preventing the reheat heat exchanger from flooding with liquid refrigerant.

Another object of the invention is to vent a reheat heat exchanger to an evaporator of a refrigerant system that is operating in a heating mode, thereby preventing the reheat heat exchanger from flooding with liquid refrigerant.

Yet another object is to use a flow restriction to vent a reheat heat exchanger to an evaporator of a refrigerant system, whereby additional cooling is achieved as the refrigerant expands upon passing through the flow restriction.

A further object of the invention is to provide a valve system that selectively reconfigures a refrigerant system in a normal cooling mode, a reheat cooling mode, and a heating mode.

A still further object of the invention is to split the flow of refrigerant flowing from a reheat condenser into a major portion and a minor portion of refrigerant, wherein the major portion is directed toward a water-cooled condenser to expel an appreciable amount of heat to the water, whereby a refrigerant system operating in a reheat cooling mode can still provide an appreciable amount of latent cooling.

Another object is to provide a refrigerant system with a check valve that allows deactivating a reheat heat exchanger when the system is operating in a normal cooling mode.

Another object is to provide a refrigerant system with a check valve that allows deactivating a reheat heat exchanger when the system is operating in a heating mode.

Yet, another object of the invention is to take the refrigerant discharging from a secondary heat exchanger and divide the refrigerant into two portions with one having a higher concentration of liquid than the other, so that the liquid portion can be directly flashed into an evaporator without having to first pass through a condenser.

These and other objects of the invention are provided by a refrigerant system that includes an evaporator for cooling air and a reheat heat exchanger that reheats the air in a reheat cooling mode. The reheat heat exchanger actively heats the air in the reheat cooling mode, but is relatively inactive in a normal cooling mode. In the normal cooling mode, a flow restriction vents the inactive reheat heat exchanger to the evaporator to help prevent the reheat heat exchanger from flooding with liquid refrigerant.

The present invention provides a refrigerant system using a refrigerant to transfer heat between air and a fluid, wherein the air is supplied to a comfort zone. The system comprises: a compressor adapted to compress and discharge the refrigerant; a fluid heat exchanger having a refrigerant passageway in heat transfer relationship with the fluid; a primary heat exchanger that places the refrigerant in heat transfer relationship with the air; a secondary heat exchanger exposed to the air; a primary refrigerant flow restriction that helps couple the primary heat exchanger to the fluid heat exchanger; a secondary refrigerant flow restriction that helps couple the primary heat exchanger to the secondary heat exchanger; and a flow divider having an inlet, a first outlet and a second outlet. The inlet is adapted to receive the refrigerant discharged from secondary heat exchanger, the first outlet is adapted to discharge a first portion of the refrigerant toward the primary heat exchanger and the second outlet is adapted to discharge a second portion of the refrigerant toward the refrigerant passageway of the fluid heat exchanger. The first portion has a greater concentration of refrigerant in a liquid state than the second portion.

The present invention also provides a refrigerant system using a refrigerant to transfer heat between air and a fluid, wherein the air is supplied to a comfort zone. The system comprises a compressor adapted to compress and discharge the refrigerant; a fluid heat exchanger having a refrigerant passageway in heat transfer relationship with the fluid; a primary heat exchanger that places the refrigerant in heat transfer relationship with the air; a secondary heat exchanger exposed to the air; a primary refrigerant flow restriction that couples the primary heat exchanger to the fluid heat exchanger; a secondary refrigerant flow restriction that couples the primary heat exchanger to the secondary heat exchanger; and a reheat valve. The reheat valve is selectively operable in a normal mode and a reheat cooling mode and has a first outlet in refrigerant communication with the refrigerant passageway of the fluid heat exchanger, a second outlet in refrigerant communication with the secondary heat exchanger, and an inlet situated to receive compressed refrigerant from the compressor. With the reheat valve in the normal mode most of the refrigerant discharged from the compressor bypasses the secondary heat exchanger and the secondary refrigerant flow restriction and passes in series through the inlet of the reheat valve, the first outlet, the refrigerant passageway of the fluid heat exchanger, the primary refrigerant flow restriction, and the primary heat exchanger. With the reheat valve in the reheat cooling mode most of the refrigerant discharged from the compressor bypasses the secondary refrigerant flow restriction and passes in series through the inlet of the reheat valve, the second outlet, the secondary heat exchanger, the fluid heat exchanger, the primary refrigerant flow restriction, and the primary heat exchanger.

The present invention further provides a refrigerant system using a refrigerant to transfer heat between air and a fluid, wherein the air is supplied to a comfort zone. The system comprises a compressor adapted to compress and discharge the refrigerant; a fluid heat exchanger having a refrigerant passageway in heat transfer relationship with the fluid; a primary heat exchanger that places the refrigerant in heat transfer relationship with the air; a secondary heat exchanger exposed to said air; a primary refrigerant flow restriction coupling the primary heat exchanger to the fluid heat exchanger; a secondary refrigerant flow restriction coupling the primary heat exchanger to the secondary heat exchanger; and a valve system. The valve system is situated to receive compressed refrigerant from the compressor and is selectively operable in a heating mode, a normal cooling mode, and a reheat cooling mode to selectively direct refrigerant flow. In the heating mode, most of the refrigerant from the compressor bypasses the secondary heat exchanger and the secondary refrigerant flow restriction and passes in series through the primary heat exchanger, the primary refrigerant flow restriction, and the refrigerant passageway of the fluid heat exchanger. In the normal cooling mode, most of the refrigerant from the compressor bypasses the secondary heat exchanger and the secondary refrigerant flow restriction and passes in series through the refrigerant passageway of the fluid heat exchanger, the primary refrigerant flow restriction, and primary heat exchanger. In the reheat cooling mode, most of the refrigerant from the compressor passes in series through secondary heat exchanger, the refrigerant passageway of the fluid heat exchanger, the primary refrigerant flow restriction, and the primary heat exchanger.

The present invention additionally provides a method of conveying refrigerant flow through the refrigerant system. The method applies to a refrigerant system that includes a primary heat exchanger that places a refrigerant in heat transfer relationship with air, a secondary heat exchanger exposed to the air, a fluid heat exchanger having a refrigerant passageway in heat transfer relationship with a fluid, and a primary refrigerant flow restriction that couples the refrigerant passageway of the fluid heat exchanger to the primary heat exchanger. The method comprises conveying most of the refrigerant in series through the refrigerant passageway of the fluid heat exchanger, the primary refrigerant flow restriction, and the primary heat exchanger; directing most of the refrigerant to bypass the secondary heat exchanger; and venting the secondary heat exchanger to the primary heat exchanger to prevent the secondary heat exchanger from flooding with liquid refrigerant.

The present invention yet further provides a method of conveying refrigerant flow through the refrigerant system. The method applies to a refrigerant system that includes a primary heat exchanger that places a refrigerant in heat transfer relationship with air, a secondary heat exchanger exposed to the air, a fluid heat exchanger having a refrigerant passageway in heat transfer relationship with a fluid, and a primary refrigerant flow restriction that couples the refrigerant passageway of the fluid heat exchanger to the primary heat exchanger. The method comprises conveying a major portion of the refrigerant in series through the secondary heat exchanger, the refrigerant passageway of the fluid heat exchanger, the primary refrigerant flow restriction, and the primary heat exchanger; and directing a minor portion of the refrigerant to pass from the secondary heat exchanger to the primary heat exchanger, whereby the minor portion bypasses the refrigerant passageway.

The present invention still further provides a refrigerant system comprising a refrigeration cycle and an air movement section. The refrigeration cycle including a compressor, a primary flow restrictor, and first, second and third heat exchangers operably connected into a refrigeration cycle. The air movement section includes a fan moving air sequentially over the first heat exchanger and then the second heat exchanger. The second heat exchanger has a liquid refrigerant outlet connected to an inlet of the first heat exchanger and a gas refrigerant outlet connected to an inlet of the third heat exchanger. The system further includes a valving arrangement for shiftably connecting and the second heat exchanger to either a series or a parallel arrangement with the third heat exchanger.

BRIEF DESCRIPTIONS OF THE DRAWINGS

DESCRIPTION OF THE PREFERRED EMBODIMENT

Figure 1:
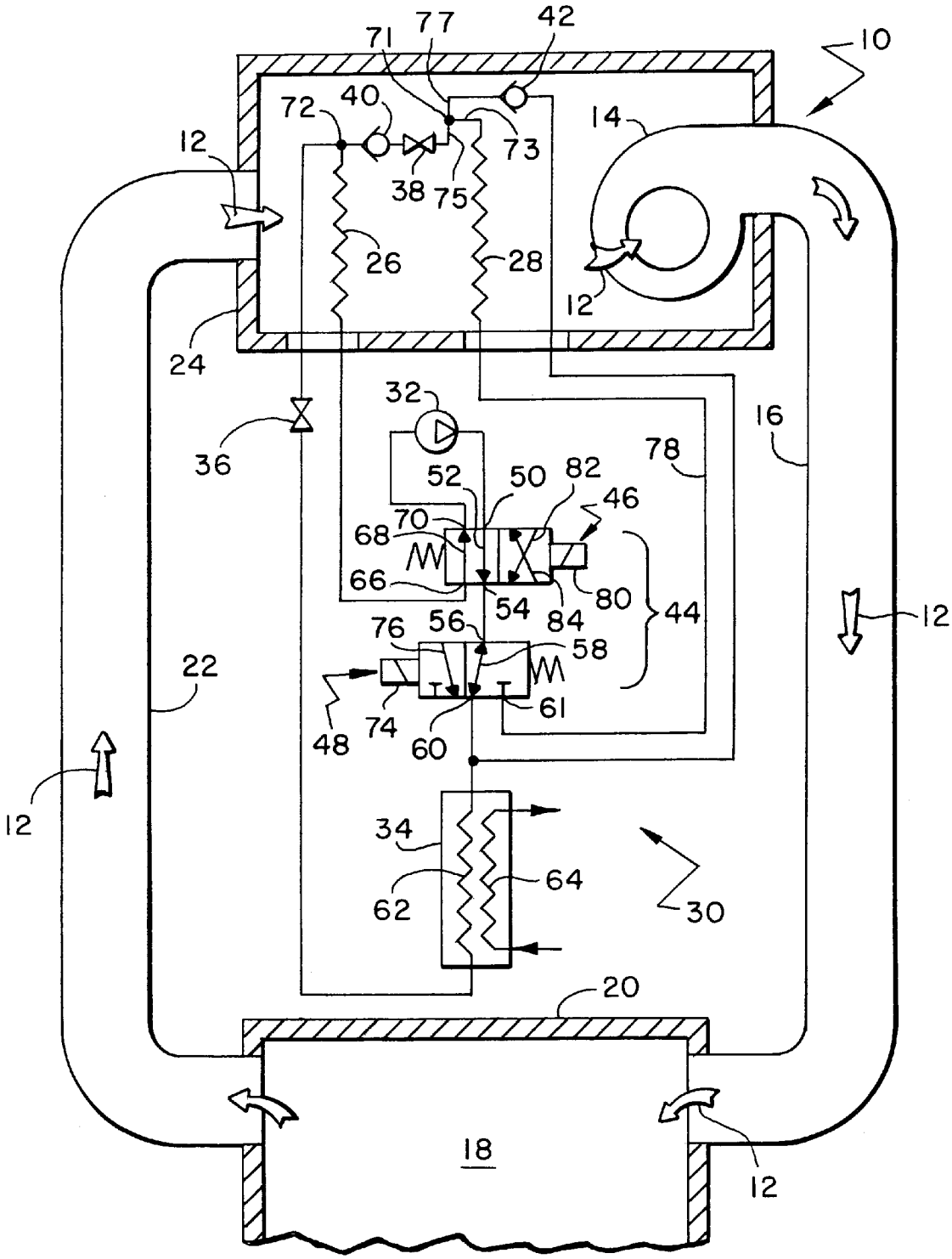
FIG. 1 is a schematic diagram of a refrigerant system in a normal cooling mode of operation according to one embodiment of the invention.

A refrigerant system 10, shown in FIG. 1, can cool, heat, and/or dehumidify a stream of air 12 that a blower 14 forces through a supply air duct 16. Duct 16 conveys the conditioned air 12 to a room 18 or some other comfort zone within a building 20. A return air duct 22 returns air 12 from within room 18 to a sheet metal enclosure 24. Within enclosure 24, blower 14 forces air 12 first across a primary heat exchanger 26 and then across a reheat heat exchanger 28, before discharging air 12 back out through supply air duct 16.

Heat exchangers 26 and 28 are part of a hermetically sealed refrigerant circuit 30 that also includes a refrigerant compressor 32 that compresses and discharges refrigerant, a fluid heat exchanger 34 (e.g., a water-cooled heat exchanger), a primary refrigerant flow restriction 36 (e.g., thermal expansion valve, electronic expansion valve, orifice, capillary tube, etc.), a secondary refrigerant flow restriction 38 (preferably a ⅛-inch diameter capillary tube, but could also be an orifice or an expansion valve), a first check valve 40, and a second check valve 42.

To reconfigure system 10 to operate in a normal cooling mode, a heating mode, or a reheat cooling mode, system 10 includes a valve system 44 that directs the flow of refrigerant along various paths through circuit 30. In some embodiments of the invention, valve system 44 comprises a reversing valve 46 and a reheat valve 48, with valve system 44 and valves 46 and 48 being schematically illustrated to encompass a broad range of readily available structures (and their locations) that can redirect the flow of refrigerant so as to achieve the results specified herein. The actuators of valve system 44 are also schematically illustrated to encompass the wide variety of well-known modes of actuation including, but not limited to, manual, solenoid, spring-return, detent or maintained positions, pilot actuation, and various combinations thereof. Nonetheless, for sake of example, reversing valve 46 is a 4-way, two-position, solenoid actuated, spring-return valve and reheat valve 48 is a 3-way, two-position, solenoid actuated, spring-return valve. The normal positions of valves 46 and 48 are as shown in FIG. 1, which places system 10 in the normal cooling mode.

In the normal cooling mode, relatively hot, compressed refrigerant discharged from compressor 32 passes in series through an inlet port 50, a passageway 52, and a first port 54 of reversing valve 46; an inlet 56, a passageway 58, and an outlet 60 of reheat valve 48; and through a refrigerant passageway 62 of fluid heat exchanger 34. Upon passing through passageway 62, the refrigerant is cooled and condensed by a relatively cool fluid, such as ground water from a well. The water or other fluid passes through a second passageway 64 in fluid heat exchanger 34 to place the fluid in heat exchange relationship with the warmer refrigerant, whereby heat exchanger 34 serves as a condenser. From there, the refrigerant passes through restriction 36, which causes the refrigerant to expand and cool. Next, the refrigerant passes through primary heat exchanger 26, as check valve 40 inhibits flow to restriction 38. Primary heat exchanger 26 serves as an evaporator as the cool refrigerant passing through it cools air 12. After leaving primary heat exchanger 26, the refrigerant returns to compressor 32 by passing in series through a second port 66, a passageway 68, and an outlet port 70 of reversing valve 46.

While in the normal cooling mode, secondary heat exchanger 28 is relatively inactive. Check valve 42 inhibits refrigerant flowing into secondary heat exchanger 28 from outlet 60 of reheat valve 48. And check valve 40 inhibits refrigerant flowing into secondary heat exchanger 28 from a point 72 between primary flow restriction 36 and check valve 40. Nonetheless, if high pressure refrigerant leaks into secondary heat exchanger 28 through slight clearances or leaks in check valve 42 or reheat valve 48, secondary flow restriction 38, in series with check valve 40, vents any buildup of high pressure refrigerant in secondary heat exchanger 28 to a low pressure side of circuit 30, such as into primary heat exchanger 26. The venting helps prevent secondary heat exchanger 28 from becoming flooded with liquid refrigerant.

Figure 2:
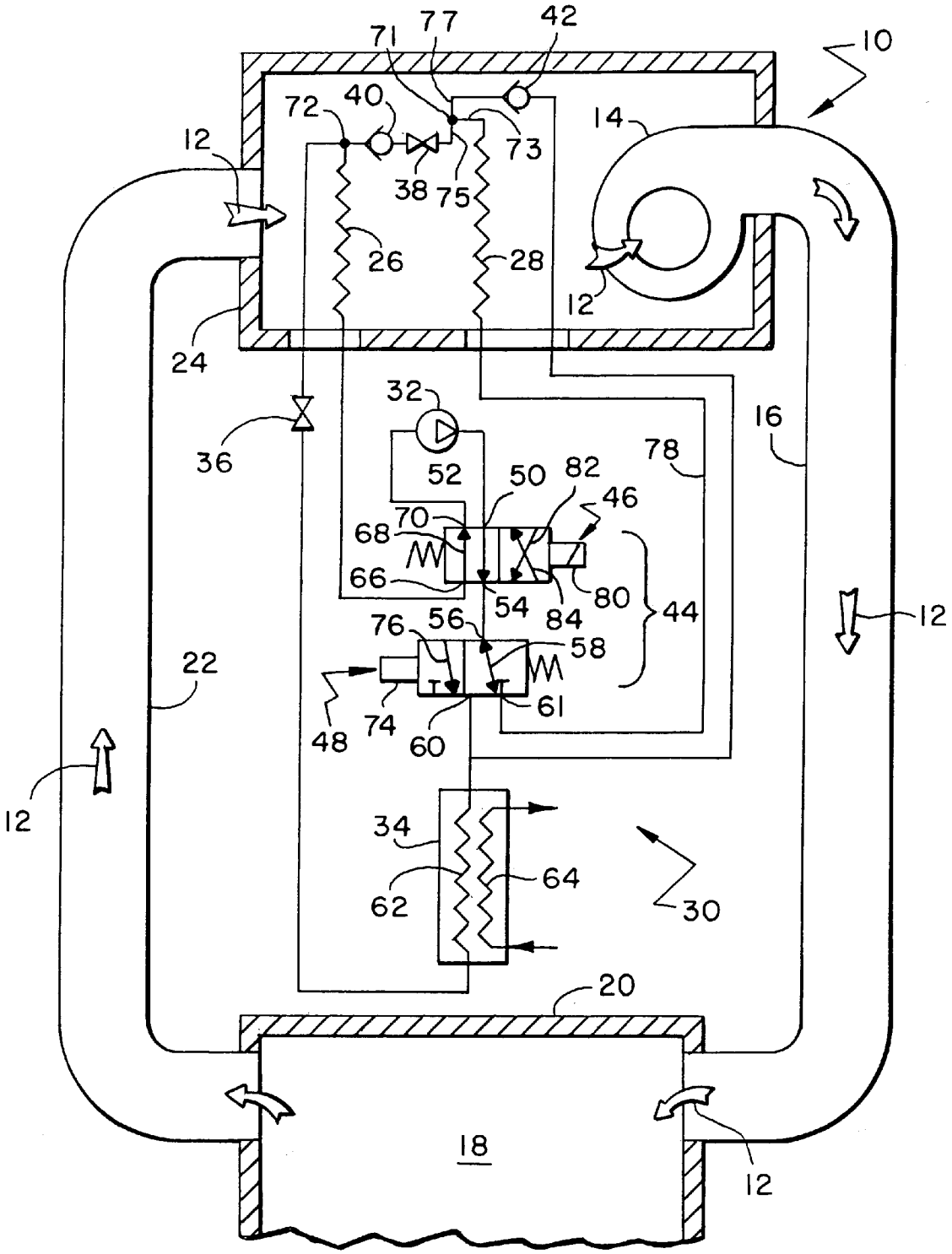
FIG. 2 is a schematic diagram of the refrigerant system of FIG. 1 in a reheat cooling mode of operation.

In the reheat cooling mode as shown in FIG. 2, energizing a solenoid 74 shifts the position of reheat valve 48, while reversing valve 46 remains in its normal position. Thus, relatively hot, compressed refrigerant from port 54 of reversing valve 46 now passes in series through inlet 56, a passageway 76, and an outlet 61 of reheat valve 48. The hot, pressurized refrigerant passes through a line 78 and secondary heat exchanger 28 to heat air 12. In other words, secondary heat exchanger 28 reheats air 12 after primary heat exchanger 26 cools air 12.

From secondary heat exchanger 28, the flow of refrigerant splits, with a major portion (i.e., most of the refrigerant) passing through check valve 42 to enter passageway 62 of fluid heat exchanger 34, and a minor portion (i.e., less than half of the refrigerant) passing through secondary restriction 38 and check valve 40 to enter primary heat exchanger 26. Upon passing through secondary restriction 38, the minor portion of refrigerant expands and cools, which helps cool air 12 that is passing across primary heat exchanger 26.

Meanwhile, the major portion of refrigerant entering passageway 62 of fluid heat exchanger 34 is cooled and condensed by the fluid passing through passageway 64. The condensed refrigerant then passes through primary flow restriction 36, which causes the refrigerant to expand and cool before joining the minor portion of refrigerant in primary heat exchanger 26. After providing most of the cooling of air 12, the major portion of refrigerant along with the minor portion leaves primary heat exchanger 26 and returns to compressor 32 by passing in series through port 66, passageway 68, and outlet port 70 of reversing valve 46.

In some forms of the invention, a flow divider 71 promotes the separation of refrigerant so that the minor portion of refrigerant passing through check valve 40 is of a higher concentration of liquid refrigerant than the major portion of refrigerant passing through check valve 42. Flow divider 71 is schematically illustrated to encompass a wide variety of well-known liquid/gas separators, such as those operating under the same basic principles as steam traps. Other examples of flow divider 71 include, but are not limited to, a simple T-connection. With the T-connection turned sideways, as shown, flow divider 71 includes a horizontal inlet 73, a lower leg 75 (first outlet) pointing downward, and an upper leg 77 (second outlet) pointing upward. In this orientation, liquid refrigerant may tend to gravitate downward through lower leg 75, while gaseous or vaporous refrigerant blows freely upward through leg 77 without having to overcome the restriction of secondary flow restriction 38.

Figure 3:
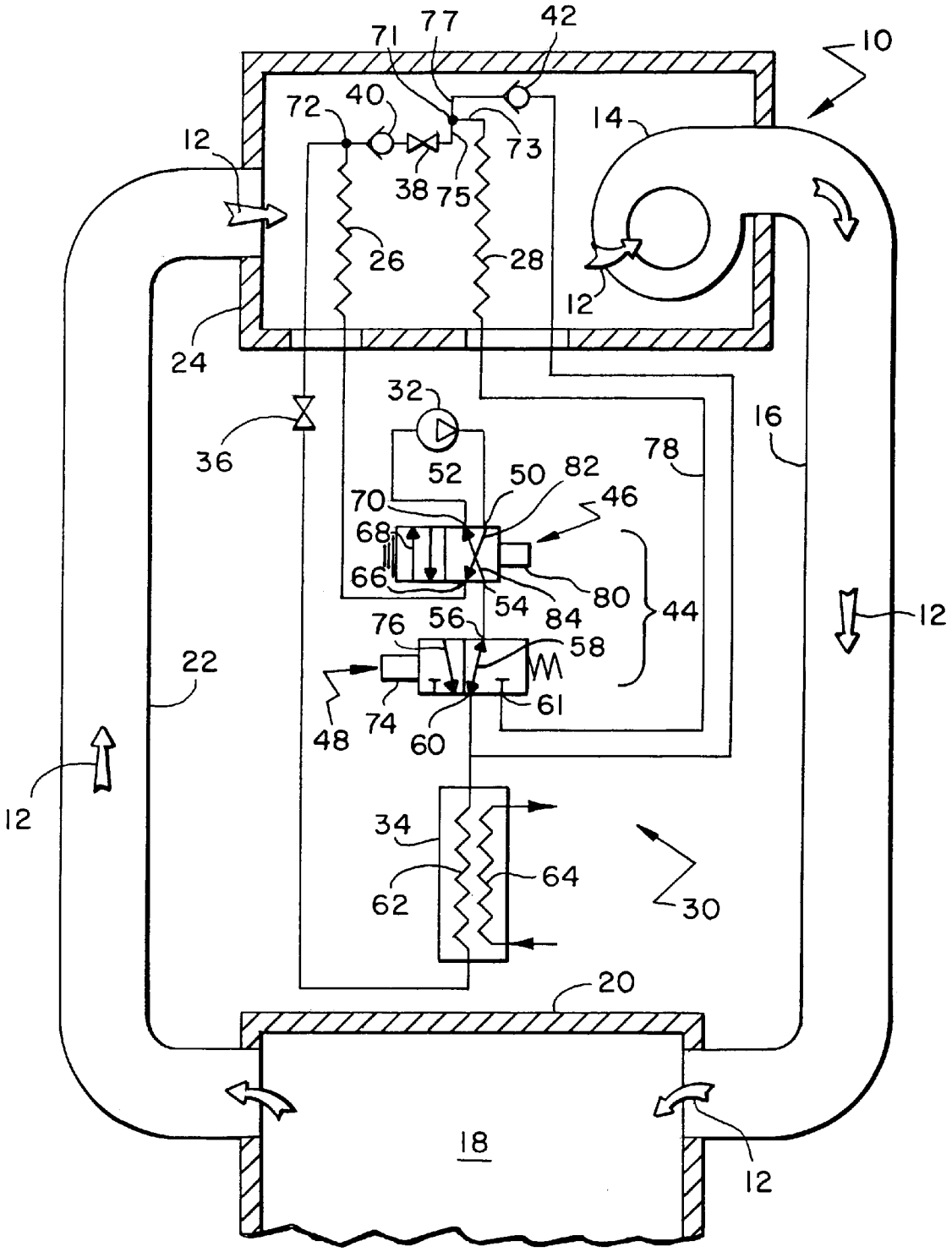
FIG. 3 is a schematic diagram of the refrigerant system of FIG. 1 in a heating mode of operation.

In the heating mode as shown in FIG. 3, energizing a solenoid 80 shifts the position of reversing valve 46, while de-energizing solenoid 74 allows reheat valve 48 to return to its normal position. Compressed refrigerant from compressor 32 now passes through a passageway 82 of reversing valve 46 to enter primary heat exchanger 26 as relatively hot refrigerant that heats air 12. From primary heat exchanger 26, the refrigerant passes through primary flow restriction 36, since check valve 40 blocks refrigerant flow to secondary flow restriction 38. Upon passing through primary flow restriction 36, the refrigerant expands and cools. The relatively cool refrigerant then passes through passageway 62 of fluid heat exchanger 34 to absorb heat from the warmer fluid passing through passageway 64. Thus, in the heating mode, fluid heat exchanger 34 functions as an evaporator. From fluid heat exchanger 34, the refrigerant returns to compressor 32 by passing in series through passageway 58 of reheat valve 48 and a passageway 84 of reversing valve 46.

Since check valve 40 helps prevent pressurized refrigerant in primary heat exchanger 26 from entering secondary heat exchanger 28, secondary heat exchanger 28 is relatively inactive during the heating mode. However, if some high pressure refrigerant happens to leak into secondary heat exchanger 28, check valve 42 vents the pressurized refrigerant to a low pressure side of circuit 30, e.g., between passageway 62 of fluid heat exchanger 34 and passageway 58 of reheat valve 48. Such venting, thus, avoids flooding secondary heat exchanger 28 during the heating mode.

Although the invention is described with respect to a preferred embodiment, various modifications thereto will be apparent to those skilled in the art. For example, although refrigerant system 10 is described as what is known as a heat pump that selectively provides cooling and heating modes, system 10 could be a cooling-only refrigerant system having a reheat mode. In other words, the heating mode, and thus reversing valve 46, can be eliminated, and such a refrigerant system would still be well within the scope of the invention. Also, the preferred implementation as a water source heat pump with hot gas reheat can be modified to encompass other HVAC applications such as split systems, rooftop systems and systems using air handlers. Therefore, the scope of the invention is to be determined by reference to the claims, which follow.

I claim:

1. A refrigerant system using a refrigerant to transfer heat between air and a fluid, wherein the air is supplied to a comfort zone, comprising:

a compressor adapted to compress and discharge the refrigerant;

a fluid heat exchanger having a refrigerant passageway in heat transfer relationship with the fluid;

a primary heat exchanger that places the refrigerant in heat transfer relationship with the air;

a secondary heat exchanger exposed to said air;

a primary refrigerant flow restriction that helps couple the primary heat exchanger to the fluid heat exchanger;

a secondary refrigerant flow restriction that helps couple the primary heat exchanger to the secondary heat exchanger; and a flow divider having an inlet, a first outlet and a second outlet, wherein the inlet is adapted to receive the refrigerant discharged from secondary heat exchanger, the first outlet being adapted to discharge a first portion of the refrigerant toward the primary heat exchanger and the second outlet being adapted to discharge a second portion of the refrigerant toward the refrigerant passageway of the fluid heat exchanger, wherein the first portion has a greater concentration of refrigerant in a liquid state than the second portion.

2. The refrigerant system of claim 1, wherein the secondary refrigerant flow restriction helps couple the primary heat exchanger to the first outlet of the flow divider.

3. The refrigerant system of claim 1, wherein the flow divider by virtue of gravity helps direct a greater concentration of refrigerant in a liquid state through the first outlet than through the second outlet.

4. The refrigerant system of claim 1, wherein the flow divider helps direct a greater concentration of refrigerant in a liquid state through the first outlet than through the second outlet by virtue of the secondary refrigerant flow restriction being coupled to the first outlet.

5. A refrigerant system using a refrigerant to transfer heat between air and a fluid, wherein the air is supplied to a comfort zone, comprising:

a compressor adapted to compress and discharge the refrigerant;

a fluid heat exchanger having a refrigerant passageway in heat transfer relationship with the fluid;

a primary heat exchanger that places the refrigerant in heat transfer relationship with the air;

a secondary heat exchanger exposed to said air;

a primary refrigerant flow restriction that couples the primary heat exchanger to the fluid heat exchanger;

a secondary refrigerant flow restriction that couples the primary heat exchanger to the secondary heat exchanger; and a reheat valve selectively operable in a normal mode and a reheat cooling mode and having a first outlet in refrigerant communication with the refrigerant passageway of the fluid heat exchanger, a second outlet in refrigerant communication with the secondary heat exchanger, and an inlet situated to receive compressed refrigerant from the compressor, such that with the reheat valve in the normal mode most of the refrigerant discharged from the compressor bypasses the secondary heat exchanger and the secondary refrigerant flow restriction and passes in series through the inlet of the reheat valve, the first outlet, the refrigerant passageway of the fluid heat exchanger, the primary refrigerant flow restriction, and the primary heat exchanger, and with the reheat valve in the reheat cooling mode most of the refrigerant discharged from the compressor bypasses the secondary refrigerant flow restriction and passes in series through the inlet of the reheat valve, the second outlet, the secondary heat exchanger, the fluid heat exchanger, the primary refrigerant flow restriction, and the primary heat exchanger.

6. The refrigerant system of claim 5, wherein more refrigerant passes through the secondary refrigerant flow restriction in the reheat cooling mode than in the normal mode.

7. The refrigerant system of claim 5, wherein at least some refrigerant passes from the secondary heat exchanger, through the secondary refrigerant flow restriction, and into the primary heat exchanger in the normal mode to prevent the secondary heat exchanger from flooding with liquid refrigerant.

8. The refrigerant system of claim 5, further comprising a check valve in series flow relationship with the secondary refrigerant flow restriction, wherein the check valve and the secondary refrigerant flow restriction couples the primary heat exchanger to the secondary heat exchanger.

9. The refrigerant system of claim 5, further comprising a check valve that inhibits refrigerant flow from the first outlet to the secondary heat exchanger.

10. The refrigerant system of claim 5, further comprising a reversing valve selectively operable in a cooling mode and a heating mode, such that when the reversing valve is in the heating mode while the reheat valve is in the normal mode most of the refrigerant discharged from the compressor bypasses the secondary heat exchanger and the secondary refrigerant flow restriction and passes in series through the primary heat exchanger, the primary refrigerant flow restriction, the refrigerant passageway of the fluid heat exchanger, the first outlet of the reheat valve, and the inlet of the reheat valve, and when the reversing valve is in the cooling mode while the reheat valve is in the normal mode most of the refrigerant discharged from the compressor bypasses the secondary heat exchanger and the secondary refrigerant flow restriction and passes in series through the inlet of the reheat valve, the first outlet, the refrigerant passageway of the fluid heat exchanger, the primary refrigerant flow restriction, and the primary heat exchanger.

11. The refrigerant system of claim 10, wherein the reversing valve includes an inlet port situated to receive compressed refrigerant from the compressor, a first outlet port situated to return refrigerant to the compressor, a second outlet port coupled to the inlet of the reheat valve, and a third outlet port coupled to the primary heat exchanger.

12. The refrigerant system of claim 10, wherein the fluid consists mostly of water to render the refrigerant system a water-source heat pump.

13. The refrigerant system of claim 5, wherein the primary heat exchanger is upstream of the secondary heat exchanger with respect to airflow passing across the primary heat exchanger and the secondary heat exchanger.

14. A refrigerant system using a refrigerant to transfer heat between air and a fluid, wherein the air is supplied to a comfort zone, comprising:

a compressor adapted to compress and discharge the refrigerant;

a fluid heat exchanger having a refrigerant passageway in heat transfer relationship with the fluid;

a primary heat exchanger that places the refrigerant in heat transfer relationship with the air;

a secondary heat exchanger exposed to said air;

a primary refrigerant flow restriction coupling the primary heat exchanger to the fluid heat exchanger;

a secondary refrigerant flow restriction coupling the primary heat exchanger to the secondary heat exchanger; and a valve system situated to receive compressed refrigerant from the compressor and being selectively operable in a heating mode, a normal cooling mode, and a reheat cooling mode to selectively direct refrigerant flow, wherein:

a) in the heating mode, most of the refrigerant from the compressor bypasses the secondary heat exchanger and the secondary refrigerant flow restriction and passes in series through the primary heat exchanger, the primary refrigerant flow restriction, and the refrigerant passageway of the fluid heat exchanger;

b) in the normal cooling mode, most of the refrigerant from the compressor bypasses the secondary heat exchanger and the secondary refrigerant flow restriction and passes in series through the refrigerant passageway of the fluid heat exchanger, the primary refrigerant flow restriction, and primary heat exchanger; and c) in the reheat cooling mode, most of the refrigerant from the compressor passes in series through secondary heat exchanger, the refrigerant passageway of the fluid heat exchanger, the primary refrigerant flow restriction, and the primary heat exchanger.

15. The refrigerant system of claim 14, wherein at least some refrigerant passes from the secondary heat exchanger, through the secondary refrigerant flow restriction, and into the primary heat exchanger in the normal cooling mode to prevent the secondary heat exchanger from flooding with liquid refrigerant.

16. The refrigerant system of claim 14, further comprising a check valve in series flow relationship with the secondary refrigerant flow restriction, wherein the check valve and the secondary refrigerant flow restriction couples the primary heat exchanger to the secondary heat exchanger.

17. The refrigerant system of claim 14, further comprising a check valve that inhibits refrigerant flow from the first outlet to the secondary heat exchanger.

18. The refrigerant system of claim 14, wherein the primary heat exchanger is upstream of the secondary heat exchanger with respect to airflow passing across the primary heat exchanger and the secondary heat exchanger.

19. In a refrigerant system that includes a primary heat exchanger that places a refrigerant in heat transfer relationship with air, a secondary heat exchanger exposed to the air, a fluid heat exchanger having a refrigerant passageway in heat transfer relationship with a fluid, and a primary refrigerant flow restriction that couples the refrigerant passageway of the fluid heat exchanger to the primary heat exchanger, a method of conveying refrigerant flow through the refrigerant system, comprising:

conveying most of the refrigerant in series through the refrigerant passageway of the fluid heat exchanger, the primary refrigerant flow restriction, and the primary heat exchanger;

directing most of the refrigerant to bypass the secondary heat exchanger; and venting the secondary heat exchanger to the primary heat exchanger to prevent the secondary heat exchanger from flooding with liquid refrigerant.

20. The method of claim 19, wherein venting the secondary heat exchanger to the primary heat exchanger is accomplished by way of a secondary refrigerant flow restriction that places the primary heat exchanger in fluid communication with the secondary heat exchanger with respect to the refrigerant.

21. The method of claim 20, further comprising inhibiting bi-directional refrigerant flow through the secondary refrigerant flow restriction by installing a check valve in series flow relationship therewith.

22. In a refrigerant system that includes a primary heat exchanger that places a refrigerant in heat transfer relationship with air, a secondary heat exchanger exposed to the air, a fluid heat exchanger having a refrigerant passageway in heat transfer relationship with a fluid, and a primary refrigerant flow restriction that couples the refrigerant passageway of the fluid heat exchanger to the primary heat exchanger, a method of conveying refrigerant flow through the refrigerant system, comprising:

conveying a major portion of the refrigerant in series through the secondary heat exchanger, the refrigerant passageway of the fluid heat exchanger, the primary refrigerant flow restriction, and the primary heat exchanger; and directing a minor portion of the refrigerant to pass from the secondary heat exchanger to the primary heat exchanger, whereby the minor portion bypasses the refrigerant passageway.

23. The method of claim 22, further comprising conveying the air first across the primary heat exchanger and then across the secondary heat exchanger.

24. The method of claim 22, wherein directing a minor portion of the refrigerant to pass from the secondary heat exchanger to the primary heat exchanger is accomplished by way of a secondary refrigerant flow restriction that places the primary heat exchanger in fluid communication with the secondary heat exchanger with respect to the refrigerant.

25. A refrigerant system comprising:

a refrigeration cycle and an air movement section;

the refrigeration cycle including a compressor, a primary flow restrictor, and first, second and third heat exchangers operably connected into a refrigeration cycle;

the air movement section including a fan moving air sequentially over the first heat exchanger and then the second heat exchanger;

the second heat exchanger having a liquid refrigerant outlet connected to an inlet of the first heat exchanger and a gas refrigerant outlet connected to an inlet of the third heat exchanger.

26. The system of claim 25 further including a valving arrangement for shiftably connecting the second heat exchanger in either a series or a parallel arrangement with the third heat exchanger.

* * * * *